US006375303B1

(12) United States Patent
Fukui et al.

(10) Patent No.: US 6,375,303 B1
(45) Date of Patent: Apr. 23, 2002

(54) INK JET RECORDING HEAD, INK JET CARTRIDGE AND INK JET RECORDING APPARATUS

(75) Inventors: Shigeki Fukui, Kawasaki; Masanori Takenouchi, Yokohama; Hitoshi Sugimoto, Yokohama; Shin Ishimatsu, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/422,788

(22) Filed: Oct. 22, 1999

(30) Foreign Application Priority Data

Oct. 27, 1998 (JP) ..... 10-306181

(51) Int. Cl.[7] ..... B41J 2/165
(52) U.S. Cl. ..... 347/33
(58) Field of Search ..... 347/33, 29, 20, 347/40, 44

(56) References Cited

U.S. PATENT DOCUMENTS

| | | | |
|---|---|---|---|
| 5,389,957 A | 2/1995 | Kimura et al. | 347/20 |
| 5,534,898 A | 7/1996 | Kashino et al. | 347/33 |
| 5,539,435 A | 7/1996 | Uchida et al. | 347/33 |

FOREIGN PATENT DOCUMENTS

| | | |
|---|---|---|
| EP | 0 446 885 A1 | 9/1991 |
| EP | 0 841 168 A2 | 5/1998 |
| JP | 7-132619 | 5/1995 |

*Primary Examiner*—N. Le
*Assistant Examiner*—Shih-wen Hsieh
(74) *Attorney, Agent, or Firm*—Fitzpatrick, Cella, Harper & Scinto

(57) ABSTRACT

An ink jet recording head in which a flat plate section has a recess section in its surface and an orifice plate having a plurality of openings grouped and disposed for ejecting a liquid is placed in the recess section, with the flat plate section being cleaned by a cleaning member movable perpendicularly to a direction of the disposition of the ejecting openings in a state brought into contact with a surface of the flat plate section. The recess section includes a combined curved surface made in a manner that a first curved surface having a first curvature and a second curved surface having a second curvature smaller than the first curvature are combined at a position corresponding to the deepest portion of the recess section. At this time, the first curved surface is located on the upstream side of the second curved surface in a cleaning direction of the cleaning member, and the combined curved surface extends in the disposition direction of said ejecting openings. The recess section further includes two inclined surfaces formed at both end portions of the combined curved surface to develop from the surface of the flat plate section. The two inclined surfaces are positioned to be separated by predetermined distances from both end portions of the grouped ejecting openings, respectively. This construction can reduce the ink residual on the recording head after the wiping by the cleaning member.

15 Claims, 15 Drawing Sheets

INK JET RECORDING HEAD, INK JET CARTRIDGE AND INK JET RECORDING APPARATUS

BACKGROUND OF THE INVENTION

1. Field of the Invention

The present invention relates to an ink jet recording head and an ink jet recording apparatus which perform recording by ejecting (discharging) an ink toward a record material. The invention is applicable to systems such as a word processor having a facsimile and printer section equipped with a printer, a copying machine and a communication system, which conducts the recording on record mediums such as paper, yarns, fibers, dishcloth, leather, metals, plastics, glasses and ceramics, and additionally applicable to an industrial recording apparatus involving a composite combination thereof with various types of processing units. In the invention, the "recording" signifies not only that meaningful images such as letters and figures are recorded on a record medium, but also that unmeaningful images such as patterns are recorded thereon.

2. Description of the Related Art

An ink jet recording apparatus is made to form an image of an ink dot pattern by supplying an ink to an ink jet recording head (which will be referred to hereinafter as a head) and by driving an ink droplet ejecting means such as a piezo device or an electrothermal converter, situated on the head, in accordance with image data.

In the case of color printing, a head is provided, for example, for each of yellow, Magenta, cyanogen and block inks, and in the case of a scanning type recording apparatus, these heads are mounted on a carriage which reciprocates along a record medium in predetermined directions. In a color recording apparatus, the heads for the respective colors are disposed in carriage moving directions (main scanning directions).

There is a problem which arises with the above-mentioned construction, however, in that the number of heads for the color recording increases so that the cost of the head unit increases and, additionally, so that the recording apparatus tends to increase in size.

FIG. 11 is a perspective view showing, as one example, a group of heads of a conventional ink jet color recording apparatus using inks different in density or consistency.

In this recording apparatus, a black (BK) ink head 311BK, a first cyanogen (C1) ink head 311C1, a second cyanogen (C2) ink head 311C2, a first Magenta (M1) ink head 311M1, a second Magenta (M2) ink head 311M2 and a yellow (Y) ink head 311Y are arranged in parallel.

In the case of a head group having such a construction, since there is a need for the positional accuracy of adjacent nozzles of the heads to be set up on the order of microns, its manufacturing process becomes complicated, and additionally, installation of a head for each of ink colors leads to a relatively high head cost and makes difficult the size reduction of the head unit itself. Accordingly, the recording apparatus itself tends to increase in size and additionally to become costly.

In addition, since the plurality of heads are in a separated condition, there is a need to prepare, for each of the heads, an ink suction/pressurization receiving means for removing bubbles in the interiors of the nozzles or for recovering the ink from the increasing viscosity due to its being left for a long time.

One possible solution to these problems may be that a plurality of ink jet recording heads are formed integrally on the same substrate and disposed along the main scanning directions for conducting multivalued printing.

However, the point to be improved in the recording apparatus in which each of four color inks, namely, yellow, Magenta, cyanogen and block inks, existing in the main scanning directions has different densities is that four colors×two heads, namely, inks of eight colors., are necessary.

Meanwhile, it was found that yellow and block images are sufficiently expressible in color appearance through printing density or the like, and do not require variation of the ink density. On the other hand, the ink density has relatively great influence on color images based on Magenta and cyanogen in color appearance. Hence, a multivalued color recording apparatus using the needed minimum number of inks is desirable.

Accordingly, a recording apparatus can be designed such that one type is used as each of yellow and black inks and two types are taken as each of Magenta and cyanogen inks, that is, six color inks are put to use.

FIG. 12 is an illustration of one example in which nozzles for six colors are disposed separately in two heads.

In FIG. 12, a group of nozzles comprising a nozzle group 400Y for ejecting an yellow ink, a nozzle group 400M1 for ejecting a first Magenta ink and a nozzle group 400C1 for ejecting a first cyanogen ink is formed in a recess section 357 made in a face 356 of an orifice plate 403 attached to a head 301A.

In addition, a group of nozzles comprising a nozzle group 400BK for ejecting a black ink, a nozzle group 400M2 for ejecting a second Magenta ink and a nozzle group 400C2 for ejecting a second cyanogen ink is formed in a recess section 357 made in a face 356 of an orifice plate 403 attached to a head 301B. Still additionally, in the case of an apparatus employing different ink densities, since the dot formation order or time lag has influence when different inks are mixed to produce a secondary color, it is preferable that the different inks to be mixed are adjacent to each other in the main scanning directions of printing.

The disposition shown in FIG. 12, however, creates the following problems if two heads are disposed in the main scanning directions of printing.

That is, if the two heads are disposed in parallel as shown in FIG. 12, the yellow nozzle group and the black nozzle group assume an adjacent condition, and the two-color printing are required to be conduct simultaneously.

At this time, it was found that two types of inks interfere with each other on the record material to come to the boundary portion between images, that is, the so-called bleeding occurs, which degrades the print quality. Particularly, it can occur remarkably between yellow and black between which a great color difference exists.

Therefore, it is considered that nozzle groups discharging two different inks are disposed so as not to be adjacent to each other in the main scanning directions. That is, as shown in FIG. 13, a first nozzle of a nozzle group 200M1 of a head 301A and a first nozzle of a nozzle group 200M2 thereof are placed on a line A—A.

However, in this case, a wasteful space 340 comes about in the head section so that the head itself increases in size to cause the size increase of the recording apparatus itself.

One possible solution to these problems would be that the wasteful space is removed from the head in FIG. 13 as disclosed in Japanese Unexamined Patent Publication No. (HEI) 7-132619. That is, as shown in FIG. 14, the head 301A and the head 301B are disposed and density-different inks are used to enable high-quality multivalued color recording, and additionally, the nozzles of adjacent nozzle groups are disposed in a state shifted substantially by ½ of a nozzle pitch from each other in directions different from the main scanning directions to double the resolution for formation of a color image with a high gradation.

Furthermore, as shown in FIG. 15, the employment of a head 391B having a nozzle group holding only a black ink can accomplish higher-speed printing of a black image. Additionally, in this case, by using a B section of a nozzle group of a head 391 for ejecting a black ink, a nozzle group 490Y of a head 391A for ejecting an yellow ink, a nozzle group 490M thereof for ejecting a Magenta ink and a nozzle group 490C thereof for ejecting a cyanogen ink, a color image is also printable.

Secondly, a description will be given hereinbelow of an orifice plate 403 with nozzle groups in the aforesaid heads.

FIG. 16 is a perspective view showing a conventional orifice plate 403, FIG. 17 is a cross-sectional view showing the orifice plate 403, taken along a line B—B, and FIG. 18 is a cross-sectional view showing the orifice plate 403, taken along a line E—E.

In a face 356 of the orifice plate 403, there is made a recess section 357 which has a plurality of nozzles arranged therein.

The recess section 357 has a recessed configuration comprising a curved surface formed by a combination or connection of a first surface 351 and a second surface 352 at the deepest portion L' of the recess section 357, and further comprising a third surface 353 and a fourth surface 354 provided on both sides of this curved surface.

In comparison with the second surface 352, the first surface 351 forms a curved surface having a relatively steep inclination, whereas, in comparison with the first surface 351, the second surface 352 constitutes a gentler curved surface. Accordingly, the deepest portion L' where the first surface 351 and the second surface 352 are combined is positioned above a nozzle 400, that is, on the upstream side thereof in an arrow W direction indicative of a running direction of a blade 319 for wiping out an ink attached onto the recess section 357.

Of heads manufactured so far, as shown in FIG. 17, there is a recording head using a member in which formed integrally are an orifice plate 403 having a number of common ink droplet discharging nozzles 400 and a top board 100 having groove portions forming ink passages corresponding respectively to the nozzles 400.

In an ink jet recording apparatus employing such a recording head, there is a case that wet ink is attached onto the recess section 357 due to ink mist occurring when an ink is ejected from the recording head or due to satellite ink occurring at the refilling of the ink. Additionally, for example, when the ink is sucked from the nozzle 400 for restoration processing, the ink left at the suction can be attached to the recess section 357.

Therefore, a restoring unit has been provided to remove such attached ink from an ejection surface. This restoring unit is principally made up of a suction device for discharging ink forcedly from the nozzle 400 and a wiping device for wiping and cleaning the recess section 357.

For example, the wiping device is designed to make a blade 319, made from an elastic material or the like and shown in FIG. 19, come directly into contact with the face 356 and the recess section 357 and to make the blade 319 move relatively to slide on or rub against the face 356 and the recess section 357, thereby cleaning the plurality of nozzles 400 and the portions around them for securing the ejection stability.

However, it was found that a construction in which a head 301A and a head 301B are disposed in a state shifted from each other as shown in FIG. 19 can create a problem when the blade 319 wipes and cleans (wiping) the face 356 and the recess section 357.

That is, since there is a need for the face of the orifice plate composed of a conventional top board with grooves to be as thin as possible in the vicinity of the nozzles but for the entire face to be thick sufficient to increase its strength, naturally, the entire face does not have a flat configuration but it has a recess portion.

In addition, in order to prevent the dries of the nozzles of the head, there is a need for the face to have a configuration to be covered with a cap installed commonly in a printer body; therefore, it is preferable that, in the face having the aforesaid recess portion, a part which comes into contact with the cap exists on the plane including a surface other than the recess portion.

In consequence, as shown in FIG. 17, the recess section 357 is formed at a substantially central portion of the entire face 356.

Meanwhile, in recent years, with the increasing requirements of high image quality, high density and high resistance to light, the versatility of ink in kind has taken place, so that there has existed an increasing need to handle dispersive pigment based inks in addition to a conventional water soluble dye based inks.

If a pigment ink is used in a cartridge with a conventional configuration, when the residual ink on an orifice plate is wiped out by a blade, ink accumulation occurred in the vicinity of the third surface 353 and the fourth surface 354 of the recess section 357 as shown in FIG. 16.

In general, the pigment-based ink has large molecules and has a fixedly attaching property.

For this reason, if some ink is yet left on the orifice plate after being wiped off, there is a possibility that the reception of the ink ejected becomes unstable.

In addition, the pigment ink left after wiped off can enter the nozzles due to the subsequent wiping operation by the blade, thereby causing an ejection-impossible condition.

Still additionally, in addition to the ink accumulation 500 shown in FIG. 16, the residual or leavings after the wiping can also occur slightly around the nozzles 400, which can cause the deflection of ink ejected or the ejection-impossible condition.

A conventional means to solve this problem relates to the improvement of the wiping way using a blade placed in the printer body. Since the ink used so far has been an dye ink, this conventional means has worked successfully. However, when a pigment ink is used for a higher resistance to light and higher concentration, further improvement becomes necessary.

Moreover, in addition to the aforesaid problems arising with the recess section, the following problems will arise.

That is, when sliding on the face 356 and the recess section 357, the blade 319 also slides simultaneously on a chip tank 302A and a chip tank 302B which have a flow passage for supplying the ink into a nozzle liquid chamber. The repetition of this operation can cause the ridgelines of the chip tanks 302A and 302B along the main scanning directions to damage the points A to D of the blade 319 as shown in FIG. 19. If the wiping is done in this state, the point B of the blade 319 can induce the ink leavings on the head 301A while the point C thereof can induce the ink leavings on the head 301B; whereupon the nozzles 400 become a wet condition to lead to record contortion or ejection failure.

SUMMARY OF THE INVENTION

Accordingly, it is a first object of the present invention to provide an ink jet recording head, an ink jet cartridge and an ink jet recording apparatus which can reduce the ink leavings or residual after wiping.

A second object of this invention is to provide an ink jet recording head, an ink jet cartridge and an ink jet recording apparatus which are capable of maintaining an excellent condition even if a pigment ink is put to use.

A third object of this invention is to provide an ink jet recording head, an ink jet cartridge and an ink jet recording apparatus which are capable of accomplishing less damages to a wiping blade.

For achieving these objects, in accordance with this invention, there is provided an ink jet recording head comprising a flat plate section having a recess section in its surface and an orifice plate having a plurality of openings made to eject a liquid and disposed linearly to be grouped in the recess section, with the surface of the flat plate section being cleaned by a cleaning member movable relative to the flat plate section in a direction perpendicular to a direction of the disposition of the ejecting openings in a state brought into contact with the surface of the flat plate section, wherein the recess section includes a combined curved surface made in a manner that a first curved surface having a first curvature and a second curved surface having a second curvature smaller than the first curvature are combined at a position corresponding to the deepest portion of the recess section so that the first curved surface is on the upstream side of the second curved surface in a cleaning direction of the cleaning member and made to extend in the disposition direction of the ejecting openings and further includes two inclined surfaces formed at both end portions of the combined curved surface to develop from the surface of the flat plate section in a state respectively separated from both end portions of the grouped ejecting openings existing in the vicinity of the deepest portion.

In an ink jet recording head thus constructed according to this invention, since the ejecting opening group is formed in the vicinity of the deepest portion of the recess section made in the orifice plate, the depth of the recess section assumes the minimum needed, thus making no sharp angle with respect to first and second inclined surfaces forming both end portions of the combined curved surface. Accordingly, the angles made at areas connecting the combined curved surface and the first and second inclined surfaces become blunt so that the liquid is hard to stay after the cleaning by the cleaning member.

It is also appropriate that the ejecting opening group is formed on the downstream side in the cleaning direction with respect to the deepest portion, that the surface in which the ejecting opening group is made is a general plane formed substantially perpendicularly to directions of liquid ejection by the ejecting openings, or that each of areas existing connectively between the first curved surface, the second curved surface, the two inclined surfaces and the general plane is formed as a smooth curved surface.

It is also possible that the ink jet recording head according to this invention includes an equipment body formed integrally with the orifice plate in a state where the surface of the flat plate section is used as one of component surfaces.

It is also possible that, in the equipment body, a radius of a curved surface formed on a first ridgeline portion defined by a surface, with which the cleaning member comes initially into contact with at the relative movement of the cleaning member, and the surface of the flat plate section to extend in a direction perpendicular substantially to the relatively moving direction of the cleaning member is below 0.1 mm, or that, in a second ridgeline portion defined by a surface including the recess section and a surface of the equipment body substantially perpendicular to the surface including recess section and substantially parallel with the relatively moving direction of the cleaning member, the radius of a curved surface formed on a portion on which the cleaning member slides at the relative movement is equal to or more than 0.2 mm.

Furthermore, it is also acceptable that the radius of a curved surface formed on a corner portion of the equipment body defined by the first and second ridgeline portions is equal to or more than 0.2 mm, that the starting position of the curved surface of the second ridgeline portion is separated by more than 0.1 mm from the ejecting opening closest to the second ridgeline portion, or that the liquid is a pigment ink.

Still furthermore, it is also appropriate that the ink jet recording head according to this invention is equipped with an electrothermal converter for generating thermal energy to be used for ink ejection, or that the ink jet recording head is of a type that an ink is ejected from the ejecting openings utilizing the film boiling occurring in the ink due to thermal energy from an electrothermal converter.

An ink jet cartridge according to this invention comprises the ink jet recording head according to this invention and a liquid container for holding an liquid to be supplied to the ink jet recording head.

An ink jet recording apparatus according to this invention comprises the ink jet cartridge according to this invention and a record medium conveying means for conveying a record medium onto which the liquid ejected from the ink jet recording head is adhered for recording.

In addition, the ink jet recording apparatus comprises the aforesaid ink jet recording apparatus according to this invention and a cleaning member moved relatively in a direction perpendicular to an arranging direction of ejecting openings while being brought into contact with a surface of a flat plate section of the ink jet recording head to clean the surface of the flat plate section.

According to this invention, since the ejecting opening group is formed in the vicinity of the deepest portion of the recess section made in the orifice plate, the depth of the recess section becomes at the minimum needed so that the angles made with respect to the first and second inclined surfaces forming both the end portions of the combined curved surface do not become sharp. Accordingly, the angles of the areas between the combined curved surface and the first and second inclined surfaces become blunt so that the liquid is hard to stay, and even if a pigment ink, easy to fix, is used, it is possible to maintain an excellent ink ejection condition for a long time.

Moreover, the first ridgeline portion, the second ridgeline portion and the corner portions of the equipment body formed integrally with the orifice plate are made to have a radius R, which enables less damage to the cleaning member and secures the certain cleaning of the recess section.

DESCRIPTION OF THE PREFERRED EMBODIMENTS

Embodiments of the present invention will be described hereinbelow with reference to the drawings.

(First Embodiment)

Figure 1:
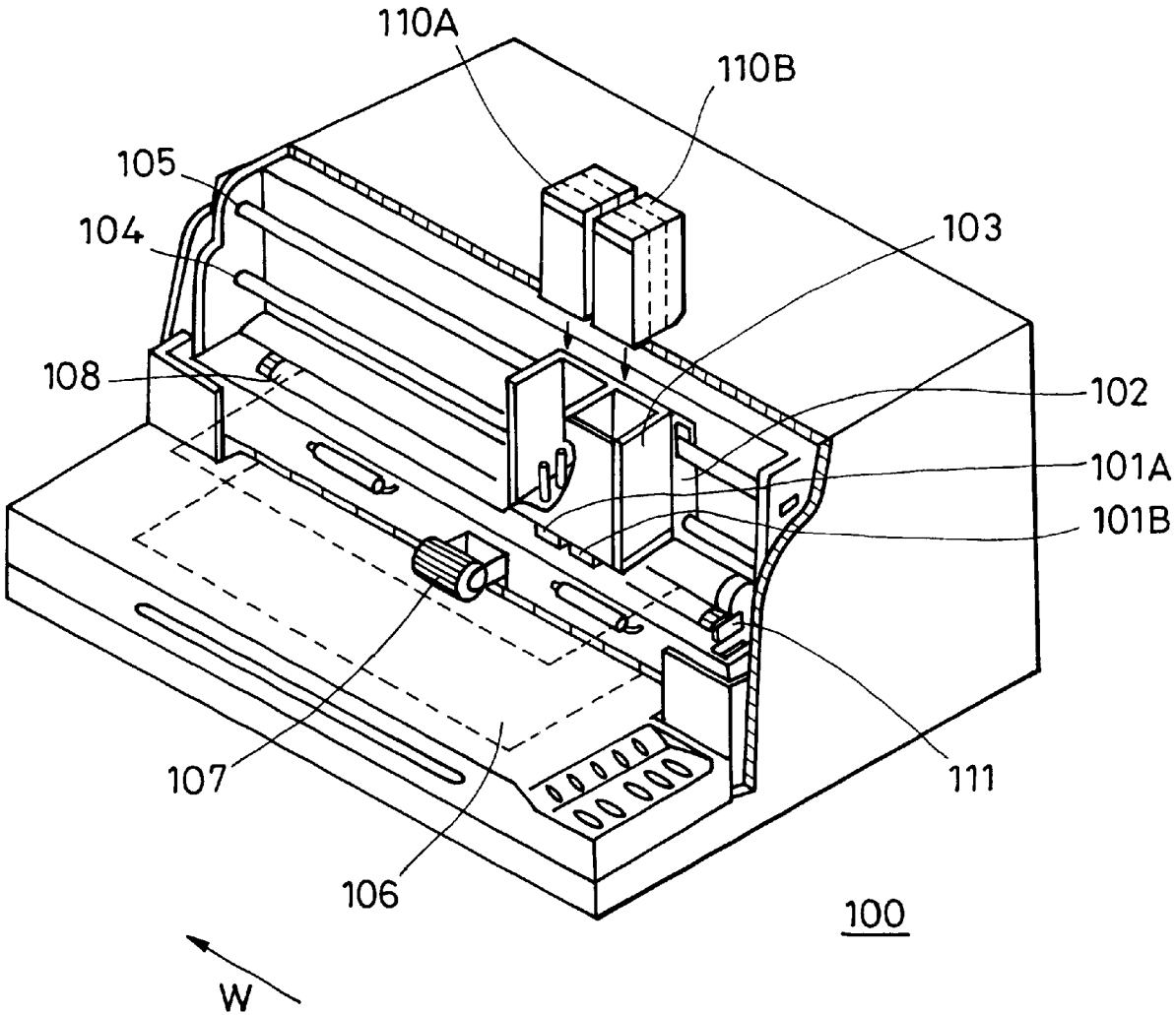
FIG. 1 shows schematically a construction of a color ink jet recording apparatus according to a first embodiment of the present invention.

FIG. 1 shows schematically a construction of a color ink jet recording apparatus according to a first embodiment of the present invention.

A recording apparatus, designated generally at reference numeral 100, is composed of a carriage 102 carrying two heads 101A and 101B and further detachably holding ink tanks 110A and 110B for supplying inks to the heads 101A and 101A, guide shafts 104 and 104 serving as a guide for the reciprocation of the carriage 102, a paper-feeding roller 107 for feeding record paper 106, a paper conveying roller 108 for conveying the record paper 106, and a blade 111 forming a component of a wiping device for restoring the printing functions of the heads 101A and 101B.

Secondly, a description will be given hereinbelow of the printing onto the record paper 106 by the recording apparatus 100.

Upon receipt of a print signal from a non-shown host computer, the record paper 106 is fed by the paper conveying roller 108 and the paper feeding roller 107 to be set at a printing position. Subsequently, the heads 101A and 101B are released from a non-shown cap, and the carriage 102 carrying the heads 101A and 101B are moved to reciprocate along the guide shaft 104 and the guide shaft 105 to conduct a printing operation on the record paper 106.

Figure 2:
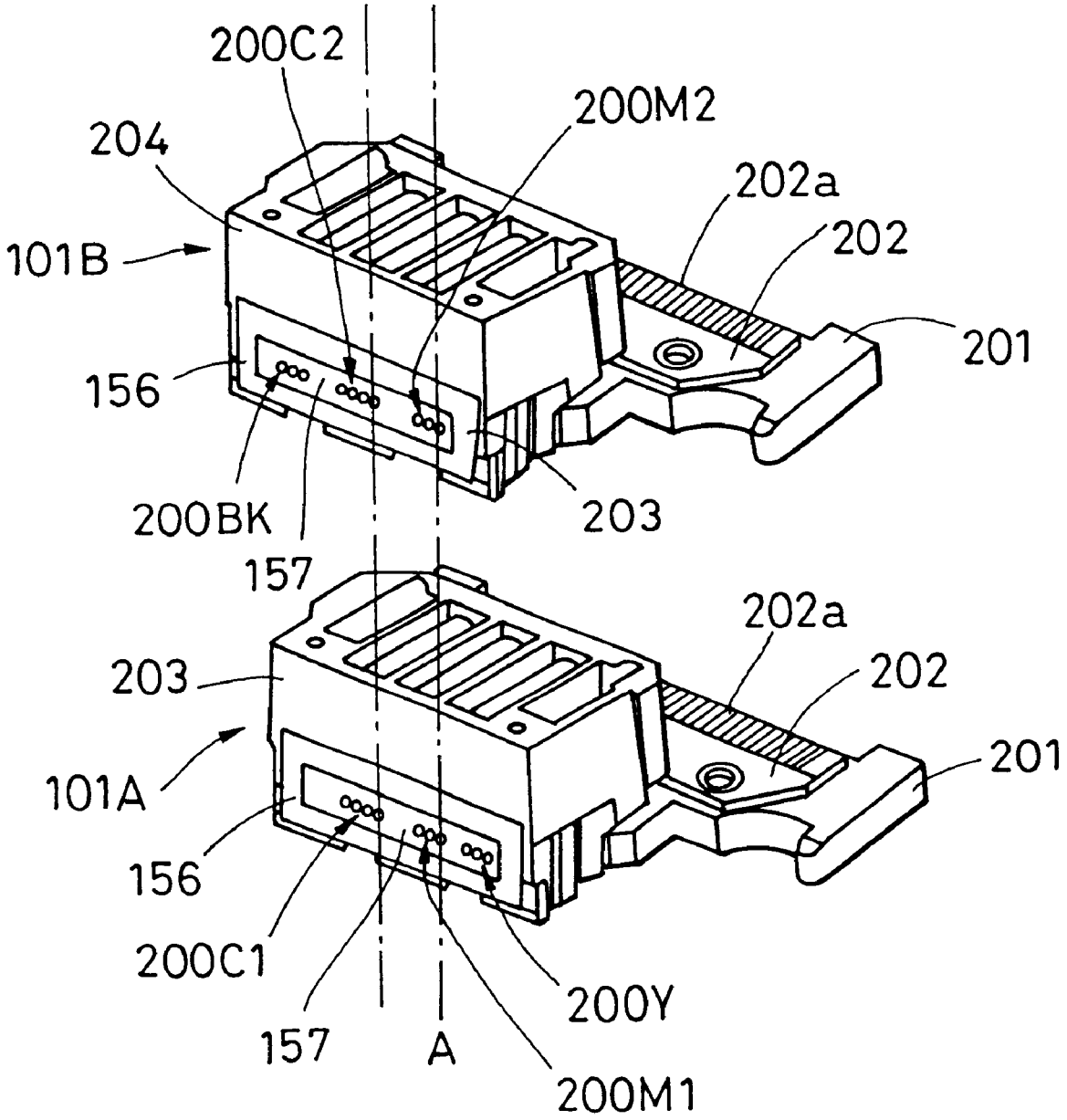
FIG. 2 is an illustration useful for describing an ink jet recording head in the first embodiment of this invention.

In the head 101A, a plurality of ejecting openings for discharging three kinds of inks, namely, a yellow ink, a first Magenta (M1) ink and a first cyanogen (C1) ink, supplied from the ink tank 110A are disposed linearly to form nozzle groups 200Y, 200M1 and 200C1 (see FIG. 2). Likewise, in the head 101B, a plurality of ejecting openings for discharging a black (BK) ink, a second Magenta (M2) ink and a second cyanogen (C2) ink supplied from the ink tank 110B are disposed linearly to form nozzle groups 200BK, 200M2 and 200C2 (see FIG. 2).

For the first Magenta and the second Magenta or the first cyanogen and the second cyanogen, a variable-density ink or different kinds of dyes can be put to use.

In addition, although the heads 101A and 101B arranged have the same construction, it is also acceptable to use different kinds of heads, for instance, different in nozzle diameter.

The construction of the heads 101A and 101B will be described in detail later.

The ink tanks 110A and 110B are for storing the aforesaid color inks, and three kinds of inks are put in each of the ink tanks 110A and 110B. When pushed into insertion openings separately provided in the cartridge 103, the ink tanks 110A and 110B are coupled to rubber seal portions (not shown) placed thereunder and further to stainless pipes or the like set in the heads 101A and 101B, respectively, so that the respective inks are supplied from the ink tanks 110A and 110B to the corresponding nozzles.

When the heads 101A and 101B are released from the non-shown cap or capped therewith, the blade 111 is moved to slide on or rub against the ink ejecting surfaces of the heads 101A and 101B, thereby removing (wiping off) the residual ink on the ejecting surfaces.

Furthermore, referring to FIG. 2, a description will be given hereinbelow of the heads 101A and 101B forming an ink jet recording head according to a first embodiment of this invention.

In the construction of each of the heads 101A and 101B, a chip tank 204 having an orifice plate 203 and a printed circuit board (PCB) 202 having a connector section 202*a* are fitted onto an aluminium-made base plate 201.

In a recess section 157 made in a face 156 of the orifice plate 203 attached to the head 101A, there are linearly formed a nozzle group 200Y for discharging an yellow ink, a nozzle group 200M1 for ejecting a first Magenta ink and a nozzle group 200C1 for ejecting a first cyanogen ink.

Likewise, in a recess section 157 made in a face 156 of the orifice plate 203 attached to the head 101B, there are linearly formed a nozzle group 200M2 for ejecting a second Magenta ink, a nozzle group 200C2 for ejecting a second cyanogen ink and a nozzle group 200BK for ejecting a black ink. Each of nozzle group is made by disposing 48 nozzles linearly, and the respective nozzle groups are arranged at an interval more than the nozzle pitch.

For each of the nozzle groups, a non-shown ink passage is formed to supply each color ink, and for each of the nozzles, a non-shown electrothermal converter is provided to eject ink droplets. In accordance with the input of a print signal from a non-shown print signal generating means, the electrothermal converter is heated to foam the ink so that the discharge of the ink droplets from each of the nozzles is controlled by that foaming force.

In this construction, two heads 101A and 101B are placed and, for each of yellow and black, one kind of ink is used while, for each of Magenta and cyanogen, two kinds of inks are employed. This construction can offer sufficient gradation, and for the following reason.

It is well known that, if a variable-density ink is used for yellow and black, the gradation further improves. In the case in which each of inks is used singly, the consistency is changeable according to the printing density. However, in the case of cyanogen and Magenta, its color tone has great influence on the saturation and the actual appearance differs. That is, in this embodiment, on the inks affected greatly by the color tome of the color print, consistency variation is taken for achieving high gradation.

Figure 4:
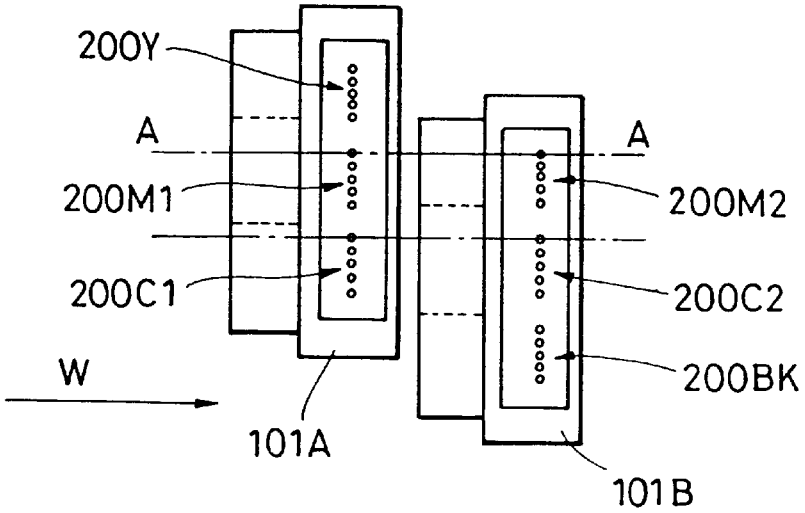
FIG. 4 is an illustration for explaining a head disposing position.

The heads 101A and 101B are arranged in a state shifted from each other in a direction different from the main scanning direction for printing so as to form a step, with the step being established by shifting the heads 101A and 101B by a distance corresponding to the width of the nozzle group for one color plus the separation for partition between the nozzle groups in the direction different from the main scanning direction (see FIG. 4).

The printed circuit board 202 is connected through its connector section 202*a* to a body side connector for receiving a power supply for the drive of the heads 101A and 101B for the ink ejection, a print signal and others.

Figure 3:
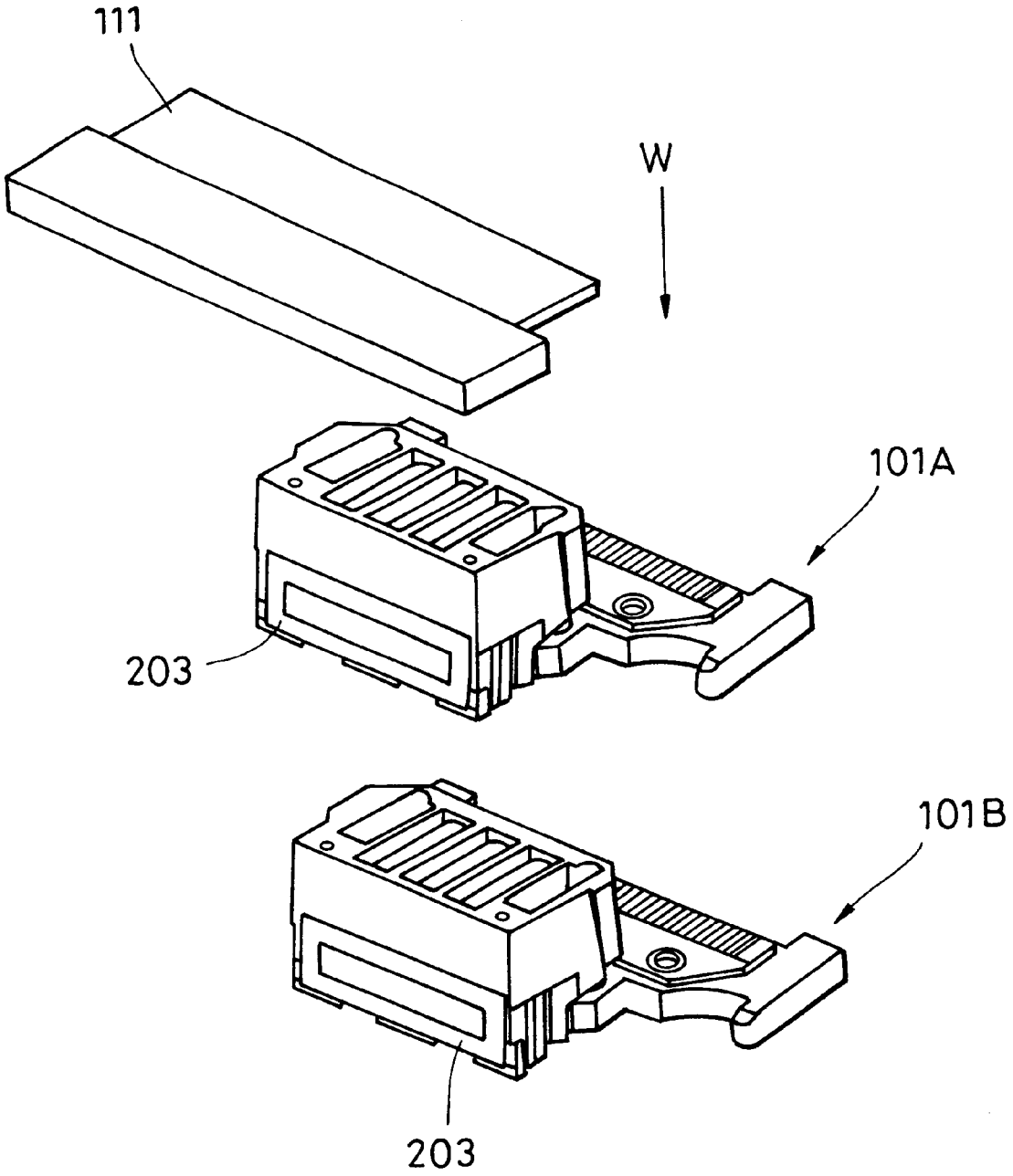
FIG. 3 is an illustration for describing a wiping state in the first embodiment of this invention.

FIG. 3 shows a state of wiping the heads 101A and 101B.

The relative movement of the blade 111 with respect to the heads 101A and 101B accomplishes the wiping in a direction indicated by an arrow W.

FIG. 4 is an illustration useful for explaining a disposing position of the heads 101A and 101B.

The adjacent nozzles in the main scanning direction of the arrow W are arranged at positions along a line A—A, that is, they are disposed so that the first nozzle of the nozzle group 200M1 of the head 101A and the first nozzle of the nozzle group 200M2 of the head 101B coincide or are aligned with each other.

Still furthermore, a description will be given hereinbelow of the recess section 157 made in the face 156 of each of the heads 101A and 101B.

In this embodiment, the recess sections 157 of the heads 101A and 101B have the same configuration, and the description will be made representatively of only the head 101A.

Figure 5:
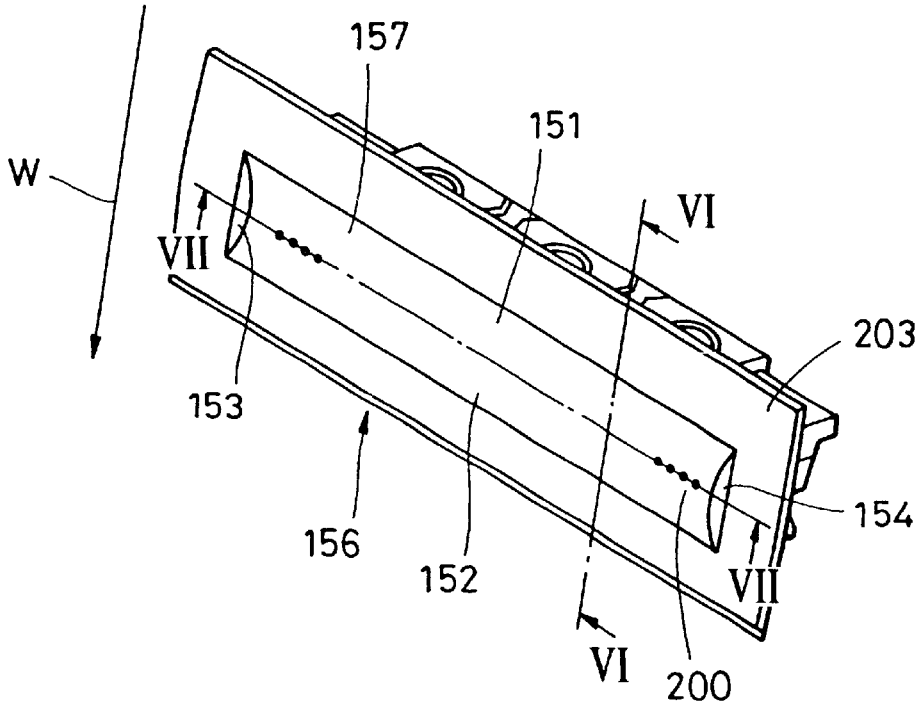
FIG. 5 is a perspective view for explaining a recess section made in a face of an orifice plate in the first embodiment of this invention.
Figure 6:
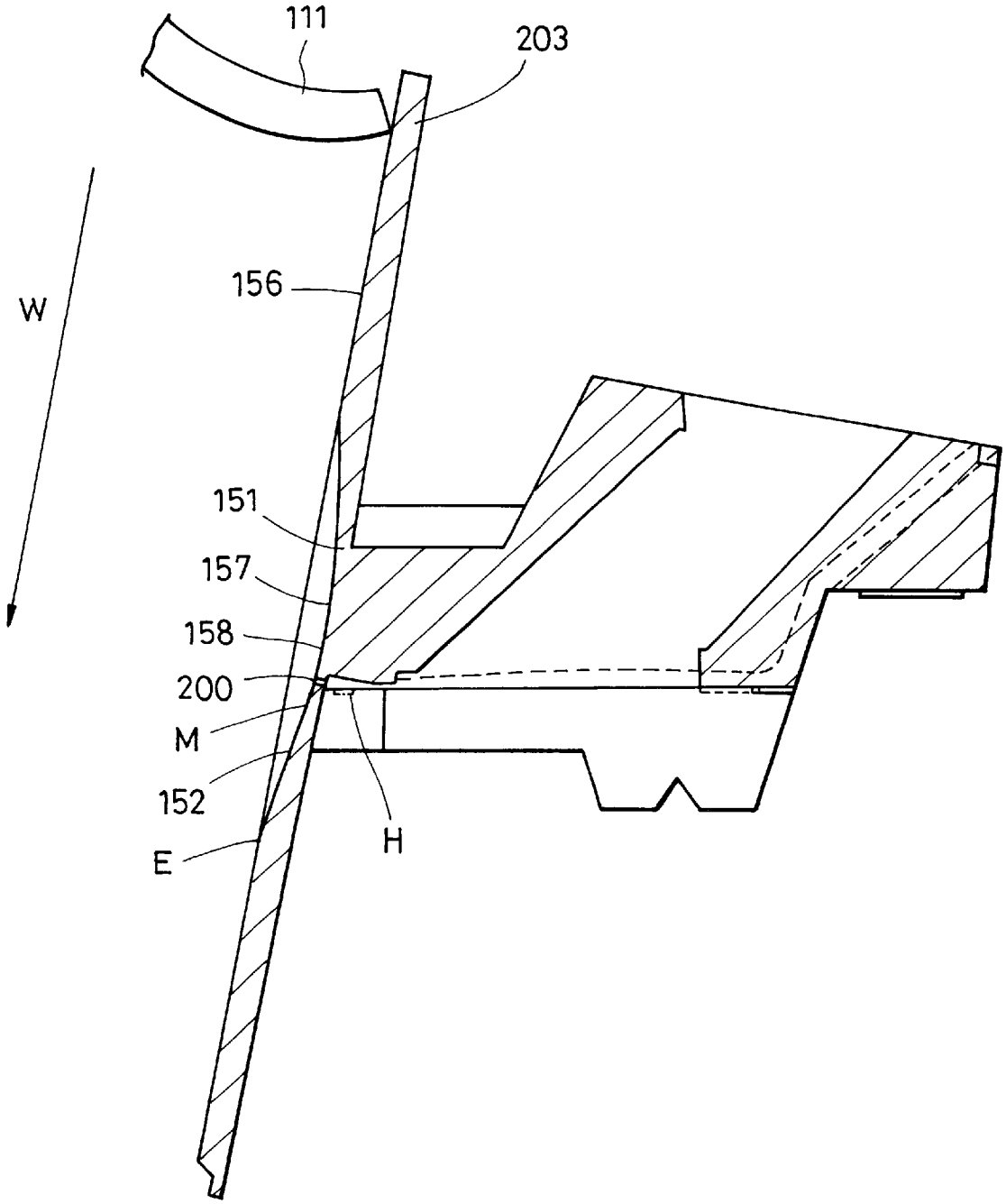
FIG. 6 is a cross-sectional view taken along a line C—C in the orifice plate shown in FIG. 5.
Figure 7:
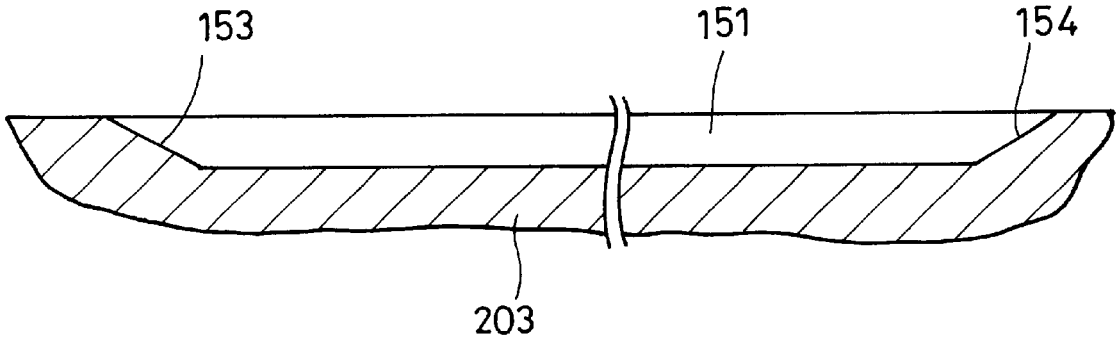
FIG 7 is a cross-sectional view taken along a line D—D in the orifice plate shown in FIG. 5.

FIG. 5 is a perspective view showing the recess section 157 made in the face 156 of the orifice plate 203, FIG. 6 is a cross-sectional view showing the orifice plate 203, taken along a line C—C of FIG. 5, and FIG. 7 is a cross-sectional view of the orifice plate 203, taken along a line D—D of FIG. 5. In FIG. 6, reference character H represents a position of the location of an electrothermal converter which generates thermal energy to be used for the ink ejection.

The recess section 157 has a concave configuration comprising a curved surface made by combining or coupling a first surface 151 and a second surface 152 at the deepest portion M of the recess section 157 as shown in FIG. 6, and further comprising third surface 153 and a fourth surface 154 formed both sides of this curved surface.

As compared with the second surface 152, the first surface 151 is formed as a curved surface having a gentler or slower curve, while, as compared with the first surface 151, the second surface 152 is formed as a curved surface having a relatively steep or high inclination. Accordingly, the deepest portion M at which the first surface 1512 and the second surface 152 are combined with each other is located under a central portion 158 of the recess section 157 made in the face 156, that is, on the downstream side of the central portion 158 in the arrow W indicative of the advancing direction of the blade 111.

Furthermore, by forming the curved surface configuration including the first surface 151 and the second surface 152 so that the deepest portion M is in the vicinity of the nozzles 200, a more optimal recess section 157 is attainable.

Still furthermore, a flat fifth surface can also be formed at a portion of the connection of the first surface 151 and the second surface 152 to limit the angle of the recess section 157 with respect to the nozzles 200, which can more preferably secure the stabilization of the ejection of the ink.

Yet furthermore, it is more desirable that a curved surface is formed at the connection between the first surface 151, the second surface 152, the third surface 153, the fourth surface 154 and the fifth surface so as to prevent the occurrence of distinct bending points.

Figure 16:
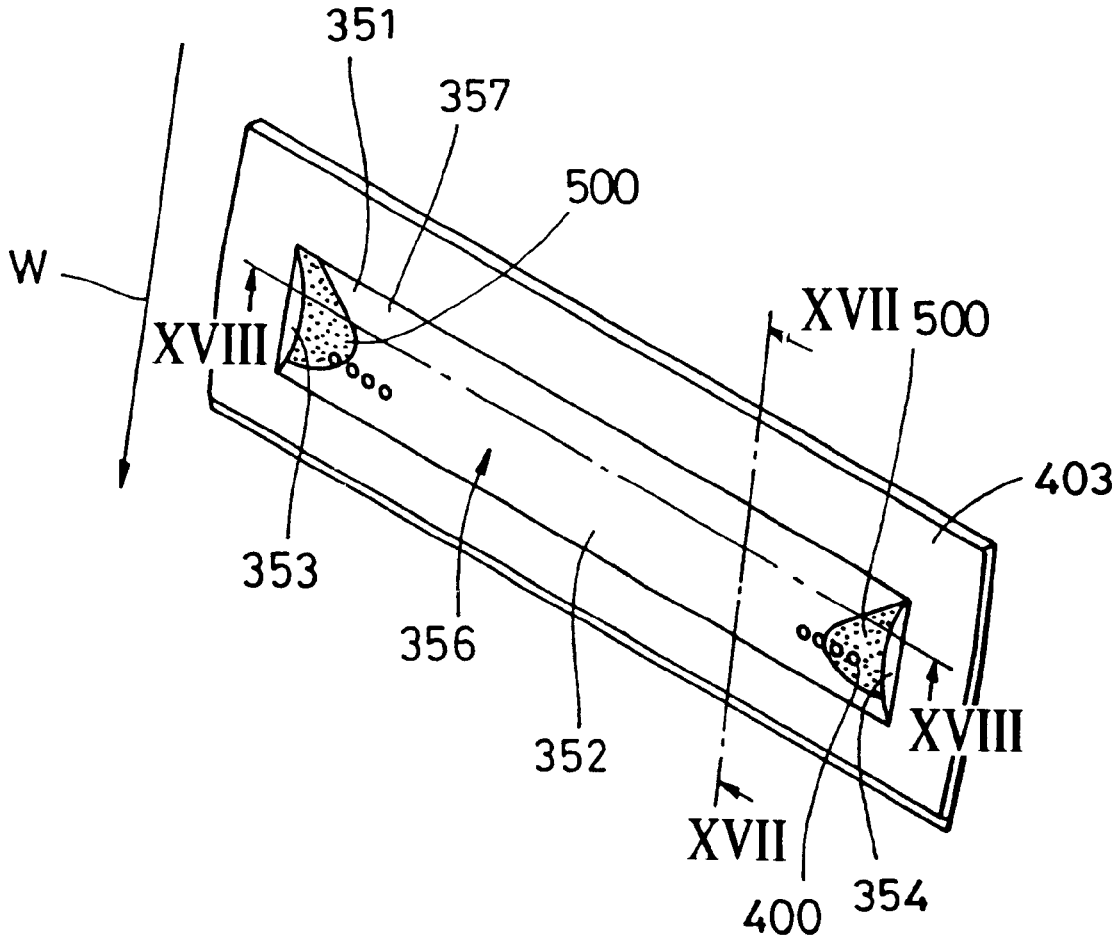
FIG. 16 is a perspective view for describing a recess section made in a face of a conventional orifice plate.

The above-described construction can improve the configuration of the recess section 157 in depth, and can solve the two problems causing ink to be left after wiping, that is, the position of the deepest portion deeper than the nozzles 200 exists on the upstream side of the positions of the nozzles 200 in the blade advancing direction and the outcome is that the inclinations of both the sides (the conventional third surface 353 and the conventional fourth surface 354 in FIG. 16) of the recess section 157 become steep.

Thus, it is possible to eliminate the problems on the ink leavings after wiping (ink accumulation 500 in FIG. 16) which will occur in the case of the use of a pigment ink, which allows the use of a pigment ink for high consistency, high resistance to light and high image quality, so that the quality of an image to be recorded on a record material is improvable.

In addition, the recess section 157 in this embodiment can offer the following effects.

Figure 17:
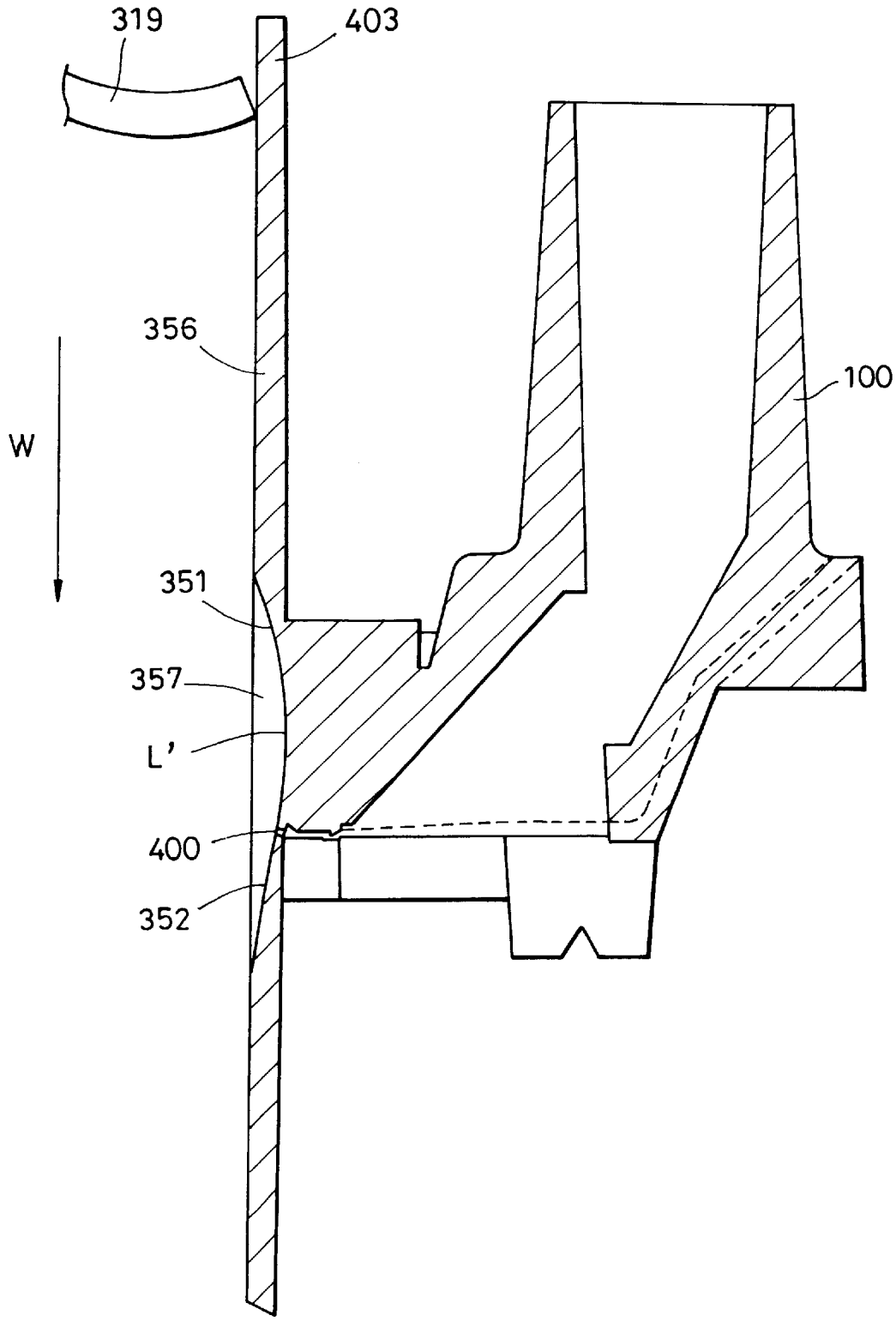
FIG. 17 is a cross-sectional view taken along a line B—B in the orifice plate shown in FIG. 16.
Figure 18:
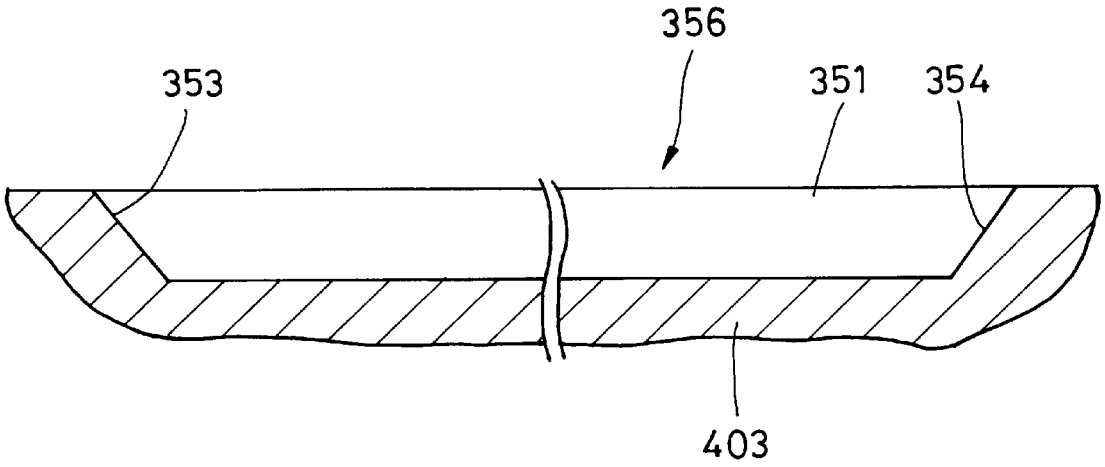
FIG. 18 is a cross-sectional view taken along a line B—B in the orifice plate shown in FIG. 16.
Figure 19:
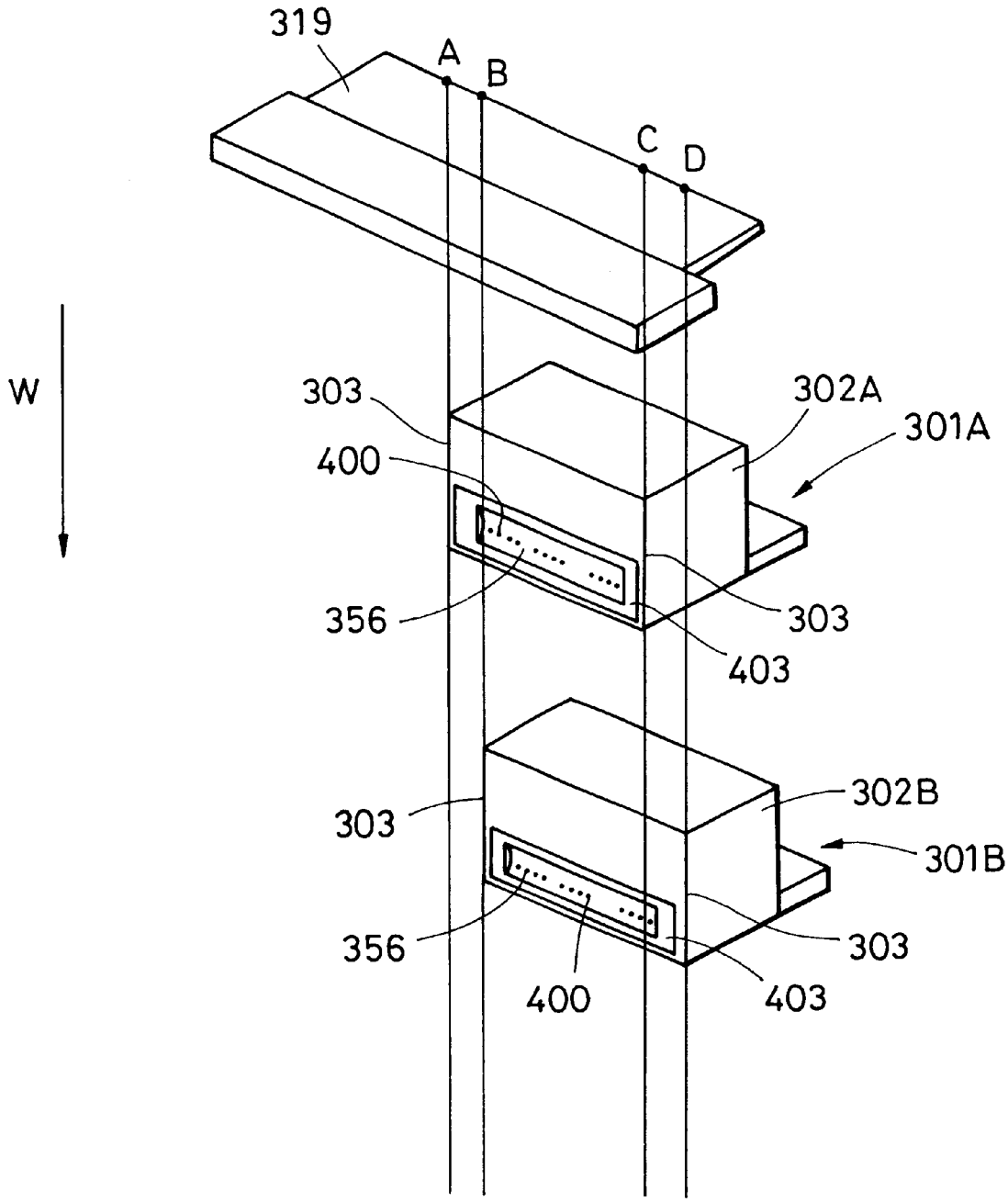
FIG. 19 is an illustration for describing a conventional wiping state.

In the case in which the two heads 101A and 101B are disposed in a state shifted from each other as shown in FIG. 4, if the recess section has a configuration equal or similar to that of the conventional recess section 357 in FIG. 17, in wiping by the blade 111, as compared with a single-cartridge construction, the advance and inclination of the blade 111 with respect to the recess section 357 are required to be set with higher precision.

One reason is that, in the case of the head construction in FIG. 3 in which the nozzle groups for ejecting two different inks are disposed without being adjacent to each other in the main scanning direction, when the residual ink on the orifice plate 203 is wiped off by the blade 111, the blade 111 vibrates after the wiping of the head 101A so that irregular wiping can come about at the wiping of the head 101B to cause the ink leavings even after the wiping.

On the other hand, the recess section 157 in this embodiment improves the wiping ability of the blade 111 to the recess section 157, so that the margin on the advance and inclination of the blade 111 with respect to the recess section 157 increases considerably and the irregular wiping is eliminable, which permits the use in a high-speed high-image-quality printer.

As described above, the recess section in this embodiment, having the foregoing configuration, accomplishes less ink residual after wiping and permits the head to employ a pigment ink.

(Second Embodiment)

Figure 8:
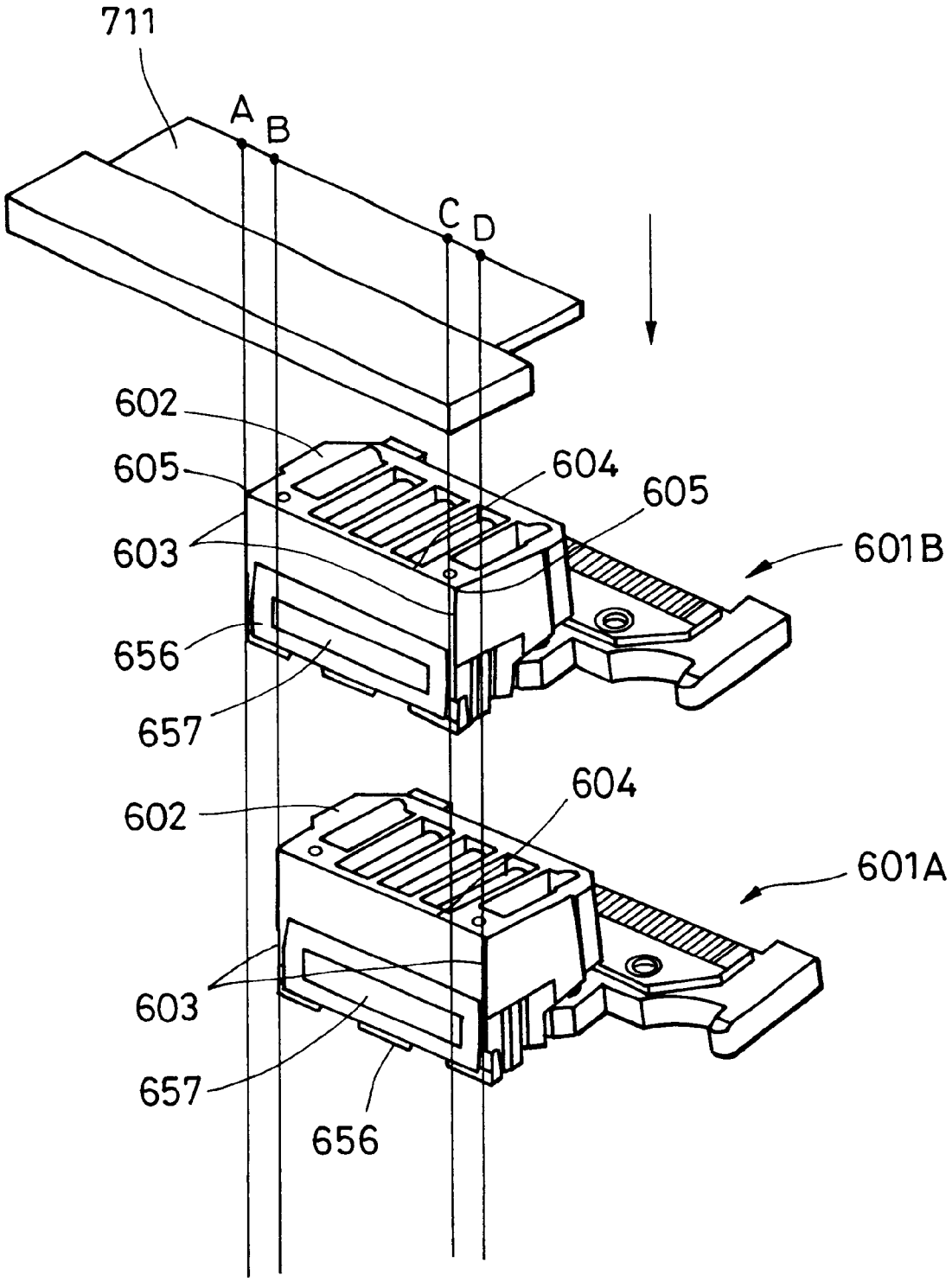
FIG. 8 is an illustration for describing a wiping state in a second embodiment of this invention.
Figure 9:
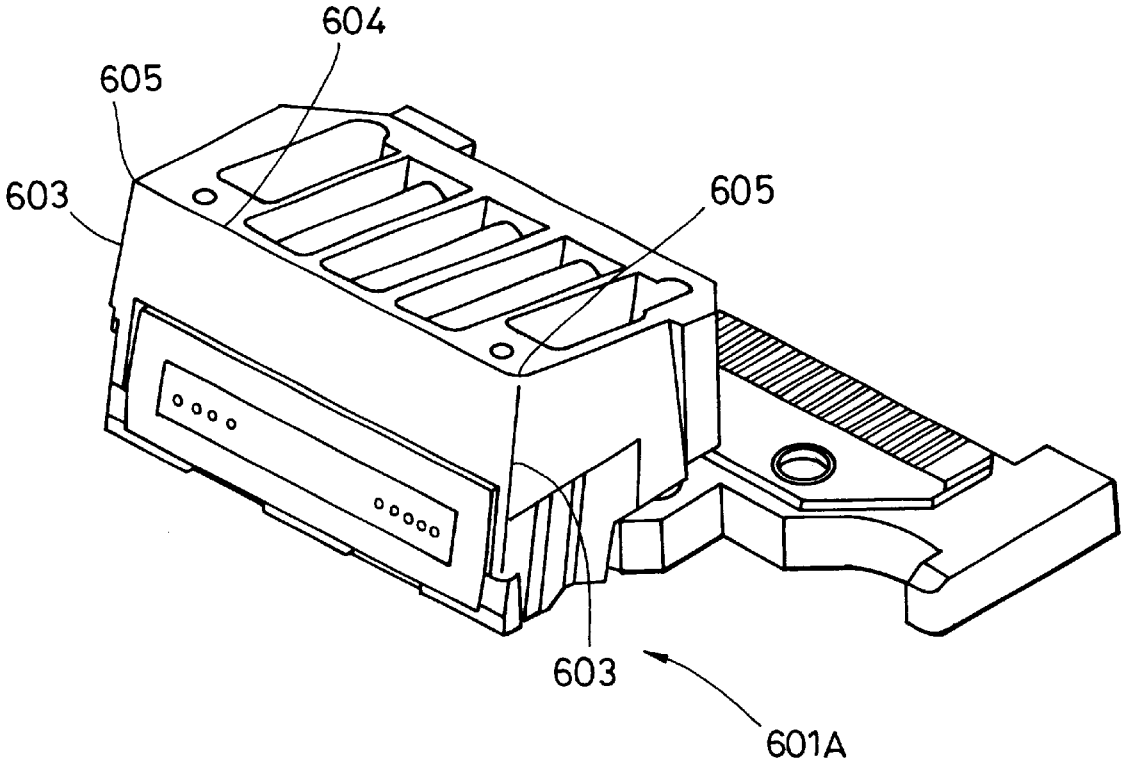
FIG. 9 is an enlarged perspective view showing a head in the second embodiment of this invention.

FIG. 8 shows wiping states of heads 601A and 601B in a second embodiment of this invention, and FIG. 9 is an enlarged perspective illustration of an appearance of a chip tank 602 of the head 601A shown in FIG. 8.

The heads 601A and 601B basically have the same construction as that of the head 101A or 101B in the first embodiment shown in FIG. 2, and the detailed description thereof will be omitted for brevity.

As FIG. 8 shows, in wiping, a portion between points A and C of a blade 711 is first brought into contact with a front edge portion 604 forming a first ridgeline portion of a chip tank 602 of the head 601A and points A and C thereof are immediately brought into contact with front edge end portions 605 forming corner portions existing at both end portions of the front edge portion 604, respectively. Following this, the portion between the points A and C of the blade 711 wipes off the ink on a face 656 and a recess section 657 while the points A and C of the blade 711 slides a ridgeline 603 forming a second ridgeline portion. Subsequently, likewise, in the blade 711, the point B instead of the point A and the point D in place of the point C are brought into contact with a front edge portion 604 forming a first ridgeline portion of a chip tank 602 of the head 601B to wipe off the ink on a face 656 and a recess section 657 while the blade 711 slides on a ridgeline 603 forming a second ridgeline portion, then terminating the wiping operation.

In the chip tanks 602A and 602B, the front edge portions 604, the front edge end portions 605 and the ridgelines 603 are formed to have a curved surface or roundness whose radius is R, thereby presenting a smooth configuration.

Incidentally, the recess section of each of the heads 601A and 601B can also be identical to that in the above-described first embodiment.

In addition, for the purpose of use in common, it is also appropriate that the chip tanks 602 of the head 601A and the head 601B have the same configuration.

Still additionally, because the width of the blade 711 is determined to wipe the recess section 657 holding the orifice nozzles, there is no need for the width to be larger than the length between the points A and D as shown in FIG. 8, and it is also possible that the width is larger than the length between the points B and C but smaller than the length between the points A and C. In this case, the ridgeline curved surface of the radius R to be formed on the front edge end portions 605 and the ridgelines 603 can be limited to only those with which the points B and C of the blade 711 come into contact.

As described above, according to this embodiment, the hip tanks 602 are constructed such that a ridgeline curved surface whose radius is R is formed on the portions with or on which the blade 711 comes into contact or slides, that is, the front edge portions 604, the front edge end portions 605 and the ridgelines 603, which prevents the damages to the blade 711.

Moreover, a description will be given hereinbelow of first to fourth study examples in the above-described embodiments.

The first to third study examples relate to a study about damages to the blade 711 and the record contortion and ejection failure which occurred in the actual printing when the radius R of the front edge end portions 603 and the ridgeline portion 603 was changed, while the fourth example relates to a study about these problems in the case in which the starting position of the ridgeline curved surface of the radius R on the ridgelines 603 was changed.

In the first study example, the ridgeline radiuses R of the front portion 604, front edge end portions 605 and ridgelines 603 of the chip tank 602 was set to R=0.05 mm, R=0.3 mm and R=0.03, respectively, and the wiping operation was repeated two hundred thousands times.

In consequence, the points A and B of the blade 711 was damaged or cut by the ridgeline 603 shown in FIG. 8. In this case, the guaranteed printing quantity of the main body was approximately fifty thousands, and the number of times of wiping was approximately two hundred thousands.

When the wiping was done in a state where the points A and B were damaged, the point A caused the ink residual on the head 601B while the point B caused the ink residual on the head 601A, so that the ejecting openings were wet to cause the record contortion and ejection failure.

Only the value of the radius R of the ridgeline 603 of the chip tank 602 was changed and the wiping operation was repeated two hundred thousands times. In this case, the examination results on the damages to the blade 711 and the record contortion and ejection failure in the actual printing are shown in Table 1.

TABLE 1

| R[mm] | 0.03 | 0.1 | 0.2 | 0.3 | 0.4 | 0.5 |
|---|---|---|---|---|---|---|
| Print Result | x | x | ○ | ○ | ○ | ○ |

Thus, when the ridgeline 603 assumes R=0.2 mm or more as a minimum, we can consider that the blade 711 is subjected to less damage so that the record contortion or ejection failure does not occur easily.

In the second study example, the ridgeline radiuses R of the front portion 604, front edge end portions 605 and ridgelines 603 of the chip tank 602 was set to R=0.05 mm, R=0.03 mm and R=0.5 mm, respectively, and the wiping operation was conducted in this condition.

In consequence, the point A caused the ink residual on the head 601B after wiping, while the point B caused the ink residual on the head 601A after wiping; whereupon, the ejecting openings were wet and the record contortion or the ejection failure occurred.

Table 2 shows the examination results on the damage to the blade 711 and the record contortion and the ejection failure in the actual printing in the case in which the value of the ridgeline curved surface radius R of the front edge end portion 605 was changed and the wiping operation was repeated two hundred thousands times.

TABLE 2

| R[mm] | 0.03 | 0.1 | 0.2 | 0.3 | 0.4 | 0.5 |
|---|---|---|---|---|---|---|
| Print Result | x | x | ○ | ○ | ○ | ○ |

Thus, when the front edge end portion 605 assumes at least R=0.2 mm or more, we can consider that the blade 711 is subjected to less damage so that the record contortion or ejection failure does not occur easily.

In the third study example, the ridgeline radiuses R of the front portion 604, front edge end portions 605 and ridgelines 603 was set to R=0.3 mm, R=0.3 mm and R=0.5 mm, respectively, and the wiping operation was conducted in this condition.

In consequence, after the wiping of the ejecting opening surface, dust and viscosity-increasing ink attached onto the blade 711 sliding surface could not be removed at the chip tank end portions, and when the wiping was conducted in this state, the dust and the viscosity-increasing ink entered the ejecting openings or adhered to the periphery of the ejecting openings, thereby further caused the record contortion or the ejection failure.

Table 3 shows the examination results about the record contortion and the ejection failure in the actual printing when the value of the ridgeline curved surface radius R of the front edge portion 604 was changed and the wiping operation was conducted in this radius R changing condition.

TABLE 3

| R[mm] | 0.03 | 0.05 | 0.1 | 0.2 | 0.3 | 0.4 |
|---|---|---|---|---|---|---|
| Print Result | ○ | ○ | ○ | x | x | x |

Thus, if the ridgeline radius R of the front edge portion 604 is below at least R=0.05, it is considered that the dust and the viscosity-increasing ink attached onto the blade 711 sliding surface can be wiped off at the aforesaid chip tank end portions, so that the record contortion and the ejection failure are hard to occur.

Figure 10:
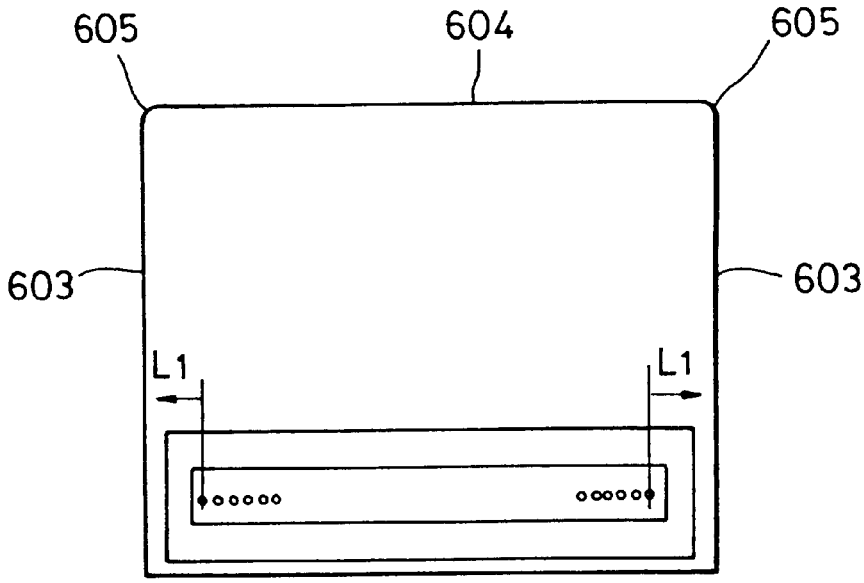
FIG. 10 is an illustration for explaining a portion having a ridgeline portion radius R made on a chip tank and a starting position of the ridgeline portion with the radius R.
Figure 11:
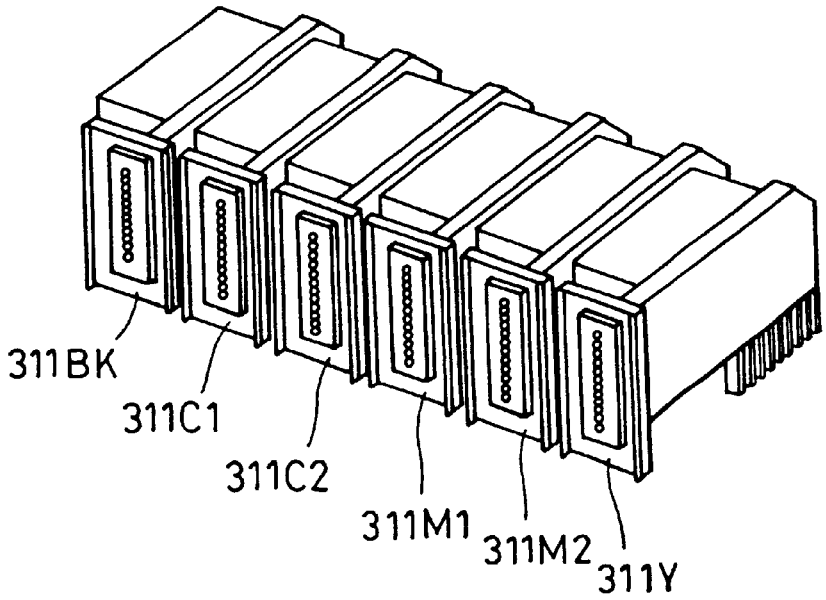
FIG. 11 is a perspective view showing a group of heads of a conventional; ink jet color recording apparatus.
Figure 12:
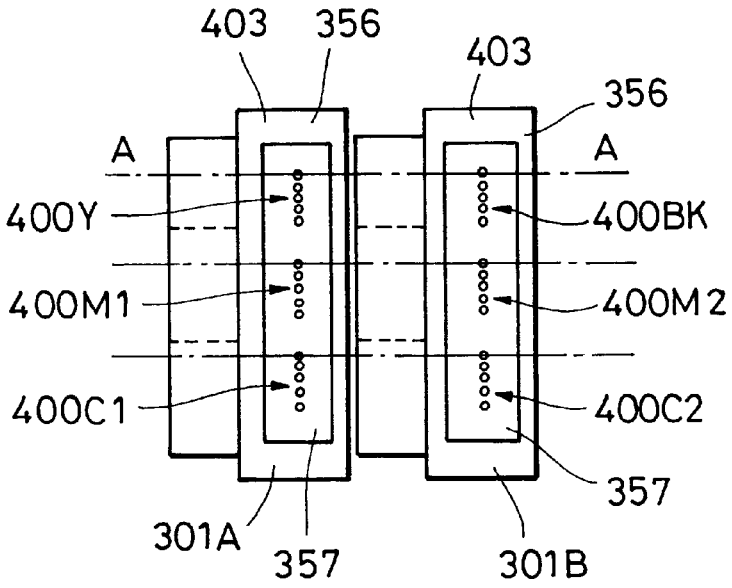
FIG. 12 is an illustration of one example of conventional head disposing positions.
Figure 13:
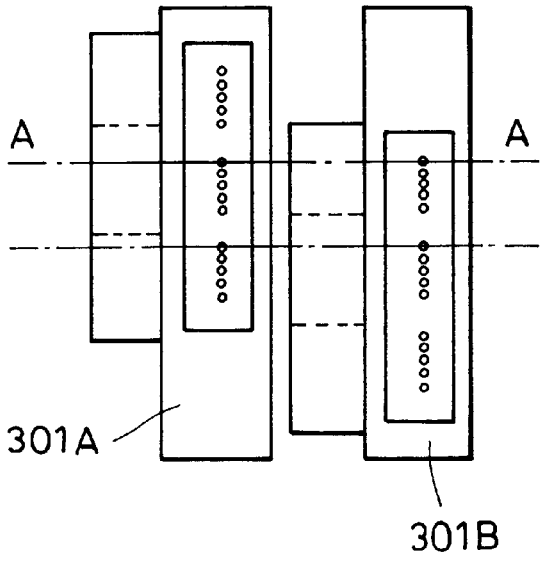
FIG. 13 is an illustration of one example of conventional head disposing positions.
Figure 14:
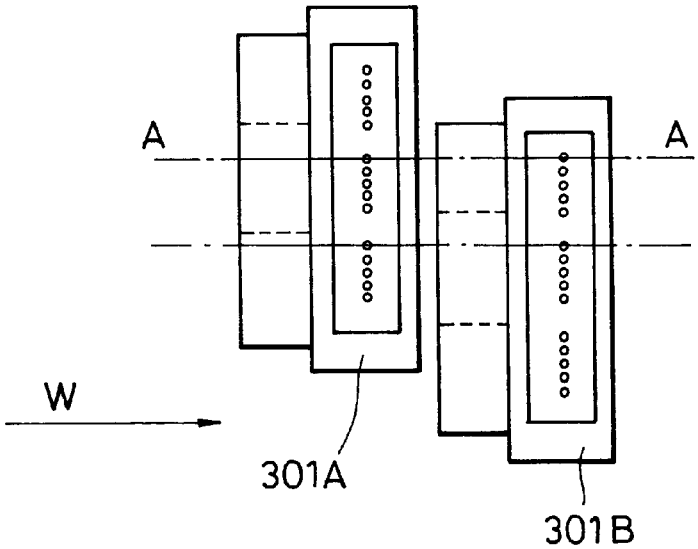
FIG. 14 is an illustration of one example of conventional head disposing positions.
Figure 15:
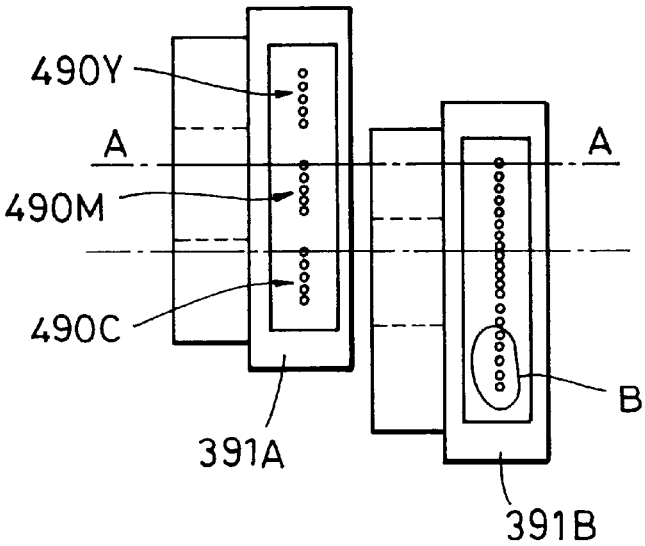
FIG. 15 is an illustration of one example of conventional head disposing positions.

In the fourth study example, the ridgeline radiuses R of the front portion 604, front edge end portions 605 and ridgelines 603 was set to R=0.05 mm, R=0.3 mm and R=0.5 mm, respectively, and the ridgeline radius R of the ridgeline 603 was started from a position separated by L1=0.03 mm from the end portion of the nozzle group as shown in FIG. 10.

In consequence, a suction device for discharging an ink forcedly from the ejecting openings could not accomplish the suction because of no complete sealing so that difficulty was encountered in removing the ink attached onto the ejecting opening surface. When the wiping was further conducted in this state, the dust (paper fuzz and others) or the viscosity-increasing ink (ink after volatile components are evaporated) entered the ejecting openings or adhered to the periphery of the ejecting openings, which caused further record contortion and ejection failure.

Table 4 shows the examination results about the record contortion and the ejection failure in the actual printing in the case in which the starting position of the curved surface, whose radius is R, with respect to the end portion of the nozzle group was changed and the wiping operation was conducted in this starting position changing state.

TABLE 4

| L1[mm] | 0.03 | 0.05 | 0.1 | 0.2 | 0.3 | 0.4 |
|---|---|---|---|---|---|---|
| Print Result | x | x | ○ | ○ | ○ | ○ |

Thus, if the starting position of the curved surface of the radius R on the ridgeline 603 is set to a position separated by at least 0.1 mm or more from the end portion of the nozzle group, it is considered that the suction device can be sealed hermetically to secure sufficient suction so that the record contortion and the ejection failure are hard to occur.

As described above, if the radius R of the curved surface of the ridgelines 603 is set to be more than R=0.2 mm, the radius R of the front edge end portions 605 is set to be more than R=0.2 mm and the radius R of the front edge portion 604 is set to be less than R=0.05 mm, the damage to the blade 711 is substantially preventable so that it is possible to surely clean the portions around the ejecting openings by the wiping.

In addition, if the starting position of the curved surface of the radius R on the ridgelines 603 is set at a position separated by at least more than 0.1 mm from the end portion of the nozzle group, it is possible to certainly clean the portions around the ejecting openings by the suction device.

Accordingly, less occurrence of the record contortion and the ejection failure becomes possible.

What is claimed is:

1. A liquid jet recording head comprising:

an orifice plate with a flat section a recess section surrounded by the flat section, said orifice plate including a plurality of ejection openings for ejecting liquid disposed linearly in the recess section, a surface of said orifice plate being in contact with and cleaned by a cleaning member movable relative to said orifice plate in a direction intersecting a disposition direction of the plurality of ejection openings, wherein the recess section includes a combined curved surface made in a manner that a first curved surface with a first curvature and a second curved surface with a second curvature smaller than the first curvature are combined at a position corresponding to a deepest portion of the recess section disposed in a vicinity of the plurality of ejection openings and extending in the disposition direction of the plurality of ejection openings so that the first curved surface is on an upstream side of the second curved surface in a cleaning direction of the cleaning member, and two inclined surfaces formed at both end portions of the combined curved surface connect the combined curved surface and a surface of the flat section.

2. A liquid jet recording head according to claim 1, wherein the plurality of ejection openings is formed on the downstream side of the deepest portion in the cleaning direction.

3. A liquid jet recording head according to claim 1 or 2, wherein a surface in which the plurality of ejection openings is located is a general plane formed substantially perpendicularly to directions of liquid ejection by the plurality of ejection openings.

4. A liquid jet recording head according to claim 3, wherein each of areas existing connectively between the first curved surface, the second curved surface, the two inclined surfaces, and the general plane is formed as a smooth curved surface.

5. A liquid jet recording head according to claim 1, further comprising an equipment body formed integrally with said orifice plate in a state where the surface of the flat section is used as a component surface.

6. A liquid jet recording head according to claim 5, wherein, in said equipment body, a radius of a curved surface, formed on a first ridgeline portion defined by a surface, which the cleaning member comes initially into contact with upon relative movement of the cleaning member, and the surface of the flat section to extend in a direction substantially perpendicular to a relative movement direction of the cleaning member, is below 0.1 mm.

7. A liquid jet recording head according to claim 6, wherein, in a second ridgeline portion defined by the surface of the flat section and a surface substantially perpendicular to a surface including the recess section and substantially parallel with the relative movement direction, a radius of a curved surface formed on a portion on which the cleaning member slides during relative movement is equal to or more than 0.2 mm.

8. A liquid jet recording head according to claim 7, wherein a radius of a curved surface formed on a corner portion defined by the first and second ridgeline portions is equal to or more than 0.2 mm.

9. A liquid jet recording head according to claim 7 or 8, wherein a starting position of the curved surface of the second ridgeline portion is separated by more than 0.1 mm from an ejection opening closest to the second ridgeline portion.

10. A liquid jet recording head according to claim 1, wherein the liquid is a pigment ink.

11. A liquid jet recording head according to claim 1, further comprising an electrothermal converter for generating thermal energy to be used for ejecting the liquid.

12. A liquid jet recording head according to claim 11, wherein the liquid is ejected from the plurality of ejection openings by film boiling, which occurs in the liquid due to the thermal energy from said electrothermal converter.

13. A liquid jet cartridge comprising a liquid jet recording head as claimed in any one of claims 1, 2, 5, 6, 10, 11, or 12 and a liquid container for holding the liquid to be supplied to said liquid jet recording head.

14. A liquid jet recording apparatus comprising:

a liquid jet cartridge as claimed in claim 13; and record medium conveying means for conveying a record medium onto which the liquid ejected from said liquid jet recording head is adhered for recording.

15. A liquid jet recording apparatus comprising:

a liquid jet recording head as claimed in claim 1; and a cleaning member arranged to move relative to said liquid jet recording head in a direction perpendicular to the disposition direction of the plurality of ejection openings while being brought into contact with the surface of the flat section to clean the surface of the flat section.

* * * * *

UNITED STATES PATENT AND TRADEMARK OFFICE

CERTIFICATE OF CORRECTION

PATENT NO. : 6,375,303 B1
DATED : April 23, 2002
INVENTOR(S) : Shigeki Fukui et al.

It is certified that error appears in the above-identified patent and that said Letters Patent is hereby corrected as shown below:

Column 1,
Line 8, “perform” should read -- performs --.

Column 2,
Line 5, “block” should read -- black --.
Line 7, “colors.,” should read -- colors, --.
Line 9, “block” should read -- black --.
Line 47, “are required to be conduct” should read -- is required to be conducted --.

Column 4,
Line 16, “the dries” should read -- drying out --.
Line 43, “after” should read -- after being --.
Line 53, “an” should read -- a --.

Column 6,
Line 31, “an” should read -- a --.

Column 7,
Line 23, “conventional;” should read -- conventional --.

Column 9,
Line 10, “tome” should read -- tone --.

Column 12,
Line 50, “was” should read -- were --.

UNITED STATES PATENT AND TRADEMARK OFFICE

CERTIFICATE OF CORRECTION

PATENT NO. : 6,375,303 B1
DATED : April 23, 2002
INVENTOR(S) : Shigeki Fukui et al.

It is certified that error appears in the above-identified patent and that said Letters Patent is hereby corrected as shown below:

Column 13,
Line 14, "was" should read -- were --.
Line 64, "with a flat section a recess section" should read -- with a flat section and a recess section --.

Signed and Sealed this

Eighteenth Day of June, 2002

*Attest:*

*Attesting Officer*

JAMES E. ROGAN
*Director of the United States Patent and Trademark Office*